United States Patent [19]

Koroly et al.

[11] Patent Number: 4,786,240

[45] Date of Patent: Nov. 22, 1988

[54] PUMPING APPARATUS WITH AN ELECTROMAGNET AFFIXED TO THE SEPTUM

[75] Inventors: Michael V. Koroly; Nathan Ida, both of Akron, Ohio

[73] Assignee: Applied Biotechnologies, Inc., Akron, Ohio

[21] Appl. No.: 86,954

[22] Filed: Aug. 19, 1987

Related U.S. Application Data

[63] Continuation-in-part of Ser. No. 011,746, Feb. 6, 1987, abandoned.

[51] Int. Cl.[4] ..... F04B 43/04

[52] U.S. Cl. ..... 417/413; 417/418

[58] Field of Search ..... 417/412, 413, 417, 418; 623/3; 128/1 D

[56] References Cited

U.S. PATENT DOCUMENTS

| | | | |
|---|---|---|---|
| 2,930,324 | 3/1960 | Toulmin, Jr. | 417/413 |
| 3,250,225 | 5/1966 | Taplin | 417/413 |
| 3,606,592 | 9/1971 | Madurski et al. | 417/413 |
| 3,720,485 | 3/1973 | Holman . | |
| 3,733,616 | 5/1973 | Willis . | |
| 3,791,769 | 2/1974 | Kovaks . | |
| 3,842,440 | 10/1974 | Karlson | 417/412 X |
| 3,919,722 | 11/1975 | Harmison | 623/3 |
| 4,210,409 | 7/1980 | Child | 417/417 |
| 4,375,941 | 3/1983 | Child | 417/418 X |
| 4,416,594 | 11/1983 | Ichikawa | 417/417 |
| 4,468,177 | 8/1984 | Strimling | 417/418 X |
| 4,498,850 | 2/1985 | Perlov et al. | 417/413 X |
| 4,512,726 | 4/1985 | Strimling . | |
| 4,524,466 | 6/1985 | Hall . | |
| 4,547,911 | 10/1985 | Strimling | 417/413 X |
| 4,557,673 | 12/1985 | Chen et al. | 417/412 |
| 4,600,405 | 7/1986 | Zibelin . | |
| 4,632,645 | 12/1986 | Kawakami et al. | 417/417 |

FOREIGN PATENT DOCUMENTS

| | | | |
|---|---|---|---|
| 0202836 | 11/1986 | European Pat. Off. | 417/412 |
| 54-113506 | 9/1979 | Japan | 417/413 |

OTHER PUBLICATIONS

Kovach, et al. Magnetically Actuated Heart Assist Pump, 1980, pp. 1068–1070.

Yarnoz et al., Magnetically Actuated LVAD, 1983, pp. 574–579.

*Primary Examiner*—Carlton R. Croyle
*Assistant Examiner*—Eugene L. Szczecina, Jr.
*Attorney, Agent, or Firm*—Renner, Kenner, Greive, Bobak, Taylor & Weber

[57] ABSTRACT

Pump apparatus (10; 110) for the controlled ingress and egress of a fluid comprising, a generally cylindrical housing (11; 111), flexible septum (55; 155) disposed within the housing and attached to the housing substantially axially medially thereof, an electromagnet assembly (65; 165, 165') affixed to the septum, a pair of inlet ports (25, 25; 125, 125) in the housing with one disposed to either side of the septum, valves (35; 135) in the inlet ports permitting only ingress of fluid to said housing, a pair of outlet ports (26, 26; 126, 126) in the housing with one disposed to either side of the septum, valves (35; 135) in the outlet ports permitting only the egress of fluid from the housing, permanent magnets (45, 46; 145, 146) disposed proximate the axial extremities of the housing, and a controller (70; 170) for selectively energizing the electromagnet assembly for the controlled displacement of the septum axially of the housing to alternately effect the ingress and egress of fluid from the inlet and outlet ports to either side of the septum.

28 Claims, 4 Drawing Sheets

PUMPING APPARATUS WITH AN ELECTROMAGNET AFFIXED TO THE SEPTUM

PUMPING APPARATUS

This is a continuation-in-part of our copending application Ser. No. 07/011,746, filed Feb. 6, 1987, entitled "Pumping Apparatus", now abandoned.

TECHNICAL FIELD

The present invention relates to a pumping device having a plurality of chambers for receiving and discharging fluids. More particularly, the present invention is a pumping device consisting of two chambers separated by a flexible septum which is reciprocated to provide for alternating ingress and egress of fluids from the two chambers. More particularly, the invention relates to a two chamber diaphragm divided housing which may be controllably actuated as a highly refined pumping device, e.g., capable of effecting the functions of the ventricles of a human heart from a remote location or by implantation in a human body.

BACKGROUND ART

With the development of increasingly sophisticated technology, pumps have been created which have demonstrated the feasibility of substituting a pump for the human heart for either temporary purposes such as during an operation or while awaiting a heart transplant or for permanent employment as a substitute for the human heart. A great variety of different types of pumps have been developed to effect these objectives. In most instances depending upon the type of actuation employed, the pump design results in a compromise of various features making it desirable for some aspects of these applications but undesirable for other aspects. Characteristics which are material in this respect include the number of moving parts, the complexity of the pump, the size of the pump, the power requirements, the extent of necessary controls and the overall reliability of the pump components.

Some of the types of pumps which have been developed for use in such a medical environment or for comparable purposes are summarized hereinafter. A common type of pump involves a floating piston movable along the length of a chamber as by a solenoid or mechanical actuation to pump fluid into and out of opposite ends of the chamber through suitable inlets and outlets. Another type of pump which has gained substantial attention involves configurations having pumping chambers of a flexible material. In some instances electrical actuation such as by a plurality of solenoids is employed to controllably distort tubes and thus sequentially displace fluid therefrom. In other instances membranes may be displaced by mechanical devices such as rotors having blades which may be rotated to alternately pump fluid into and out of a housing. Various types of rotor configurations have been employed having differing numbers of chambers which may operate via mechanical drive elements to effect a desired pumping action.

Another type of diaphragm pump which has been employed involves a piston mounting diaphragms at either end with the piston being movable axially so that the chambers formed proximate either end thereof may be increased and reduced in size alternately to effect a desired pumping action. In other instances, diaphragms dividing compartments have been provided with magnetic particles which interact with electromagnets formed in the pump housing to provide controlled displacement of the diaphragm to effect a desired input and output through suitably positioned ports. In other instances efforts have been made to effectively duplicate the actual configuration of a human heart by providing flexible membranes mounting permanent magnets which interact with electromagnets positioned in a housing thereabout to effect alternate repulsion and attraction to achieve a heart-like expansion and contraction of the chambers formed by the membranes for the pumping action.

In many instances the size of the mechanical, electrical, or mechanical and electrical components is of such a magnitude that implantation of the pump as a replacement for the human heart is impossible due to size considerations. In other instances the mechanical configuration necessary, for example, to move a piston or the electrical powering and operation of a motor or rotor makes a device undesirable for implantation or long term usage due to the fact that the number of operating components and the interactions are of such complexity as to render improbable a long term reliable operation of the pump. In some instances fluids have been employed to either actuate or control the movement of a diaphragm; however, in some of these instances it is necessary that the fluid be vented to the atmosphere thereby rendering such devices undesirable for human implant or other environmentally isolated installations. In other instances, pumps may generate sufficient vibration, noise, or heat as to limit their applicability for certain of these uses. Thus, virtually all pumping devices of this nature which have been developed to date suffer from one or more disadvantages or limitations which restrict the type or extent of their usage in environments of this nature.

DISCLOSURE OF THE INVENTION

Accordingly, an object of the present invention is to provide a pump which is of suitable operating characteristics such as to be capable of effecting the functions of the ventricles of a human heart. Another object of the invention is to provide such a pump which is of a size and configuration such as to make possible its implantation in the human body to function as the ventricles of a human heart. Still another object of the invention is to provide such a pump which can be constructed in its entirety of biologically inert materials such that it is capable of residing in or in contact with human tissue without interacting therewith.

Another object of the invention is to provide such a pump which effects direct conversion from electrical energy to mechanical displacement of fluid to be pumped without interfacing mechanical elements other than a moving membrane. Yet another object of the invention is to provide such a pump which is of a highly reliable design because of a lack of mechanical interfacing components and further because of the simplicity in the conversion of electrical energy to pumping action of a fluid. Still another object of the invention is to provide such a pump which is designed to assure that adequate fluid is available for every output stroke and that virtually all of the blood or other fluid entering the pump during each pumping cycle is discharged during the pumping stroke, such that portions of the fluid are not repeatedly processed and therefore possibly damaged in the pumping process. Yet another object of the invention is to provide a pump wherein the movable elements may be accurately controlled such that they may be stopped a distance spaced from but in close proximity to nonmoving surfaces of the pump housing such as to effect the requisite flushing of the pump chambers during each operating cycle without confining and applying excessive pressure to limited quantities of fluid which could produce damage to constituents of some operating fluids such as blood.

A still further object of the invention is to provide a pump having the required operating characteristics which consumes a minumum of energy and therefore releases a minimum of heat. Yet another object of the invention is to provide such a pump which is structured to rely extensively upon permanent magnets for a substantial portion of the actuating power and positioning control of a diaphragm containing a controlled electromagnet. Yet another object of the invention is to provide such a pump in which the movable diaphragm is under substantially uniform, accurate positioning control during the full extent of its cyclic travel.

Yet another object of the invention is to provide such a pump wherein the stroke volume, pressure and rate may be variably controlled for each of two operating chambers. Yet another object of the invention is to provide a pump capable of control interfacing with the body's own impulses or with known artificial devices providing timed cycling. A still further object of the invention is to provide such a pump wherein the overall construction and operating simplicity is such as to provide a high degree of reliability within the realm of reasonable manufacturing costs.

An alternate or second embodiment of the invention has the aforesaid characteristics and additionally provides the following further features.

An object of the alternate embodiment of the present invention is to provide a pump having two diaphragms which can be independently separately controlled. Another object is to provide such a pump wherein the diaphragm effecting pumping at any time is subject to controlled displacement by the electrical fields created while the diaphragm enclosing the portion of the housing into which fluid is filling is controlled solely by the natural rate of fill produced by pressurized fluid returning to the pump. Still a further object is to provide such a pump wherein the first and second diaphragms may be of slightly different size such that the output of fluid from the two sides of the housing separated by the septum may be varied.

Yet another object of the alternate embodiment is to provide a pump which can thus accommodate a shunting of a portion of the operating fluid as might be encountered in periods of extraordinary use of blood in human heart environment applications without having a positive pumping demand on return fluid which may cause the atrium or great vessels supplying the pump to collapse. Another object is to provide a pump wherein the compartment between the diaphragms is interconnected with a compliance chamber to preclude substantial variations in air pressure between the first an second diaphragms and thus insure their independent operation as specified hereinabove. A still further object of the present invention is to provide a pump which remains relatively simple in having only two primary moving parts such as to provide a high degree of reliability at reasonable manufacturing costs.

In general, the present invention contemplates pump apparatus for the controlled ingress and egress of a fluid having a generally cylindrical rigid housing, a flexible septum disposed within the housing and attached to the housing substantially axially medially thereof, an electromagnet affixed to the septum, a pair of inlet ports in the housing with one disposed to either side of the septum, a valve in each inlet port permitting only the ingress of fluid to the housing, a pair of outlet ports in the housing with one disposed to either side of the septum, a valve in each outlet port permitting only the egress of fluid from the housing, permanent magnets disposed proximate the axial extremities of the housing, and a controller for selectively energizing the electromagnet for the controlled displacement of the septum axially of the housing to alternately effect the ingress and egress of fluid from the inlet and outlet ports to either side of the septum. An alternate embodiment of the invention has as the septum first and second diaphragms with an electromagnet affixed to each diaphragm.

PREFERRED EMBODIMENT FOR CARRYING OUT THE INVENTION

Figure 1:
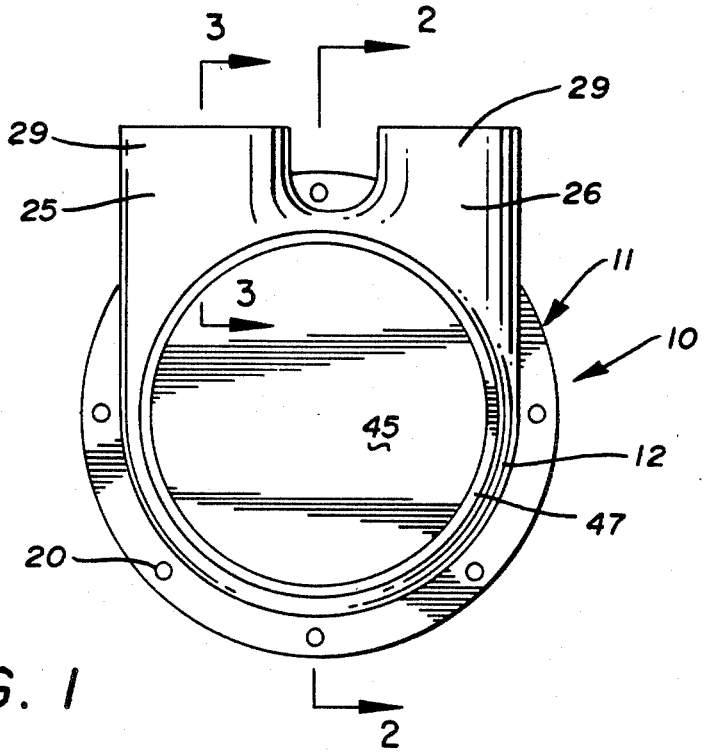
FIG. 1 is a side elevational view of pump apparatus embodying the concepts of the present invention and showing an inlet and an outlet port which communicate with one of two chambers within the housing.
Figure 2:
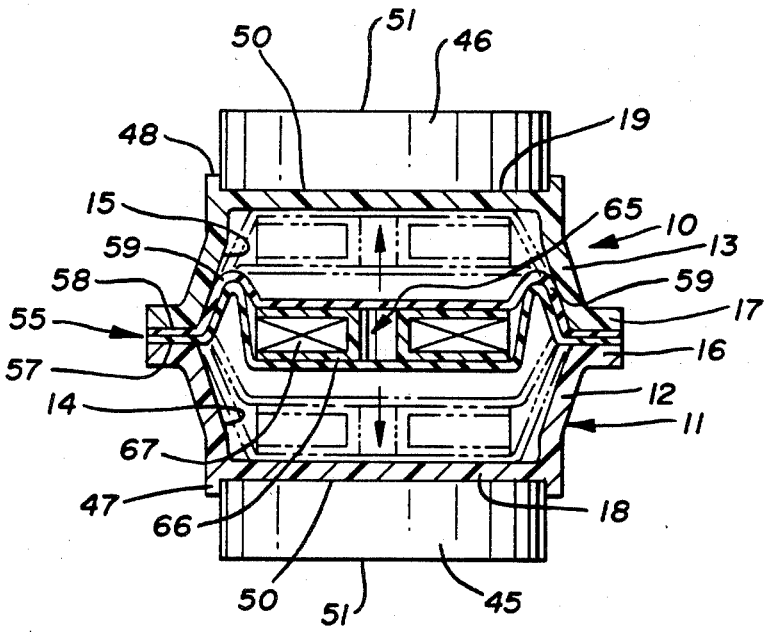
FIG. 2 is a sectional view taken substantially along the line 2—2 of FIG. 1 and depicting details of the septum within the housing which divides it into two chambers of varying sizes upon actuation of the septum.

Referring now to the drawings and particularly to FIG. 1 thereof, pump apparatus embodying the concepts of the present invention is generally indicated by the numeral 10. The pump 10 has a substantially closed, cylindrical housing, generally indicated by the numeral 11. As best seen in FIG. 2, the pump housing 11 may be constructed of two cup shaped sections 12 and 13. Each of the cup shaped sections 12 and 13 are hollow as defined by interior walls 14 and 15 which terminate in radially outwardly projecting flanges 16 and 17. The axial extremity of sections 12, 13 opposite the flanges 16, 17 have cylindrical end walls 18 and 19, respectively. The closed configuration of the housing 11 is effected by joining the flanges 16 and 17 about their entire peripheries. The sections 12 and 13 may be selectively joined as by a plurality of fasteners 20 such as screws or bolts which permit the sealed joinder of sections 12 and 13 or their intermittent disassembly for purposes of repair or replacement, cleaning or adjustment of parts within the housing 11.

For general pumping applications, the housing 11 may be constructed of polyurethane, epoxy, or other plastics having comparable properties. If the pump 10 is to be used as an artificial heart the housing 11 or at least the fluid contacting surfaces would be constructed of a substantially rigid but suitably inert material with respect to blood such as titanium or a urethane polymer such as a product sold under the name Pellathane. For reasons which will be hereinafter apparent, the material of the housing 11 should in addition to being biologically inert be of a nonmagnetic material which would not affect or be affected by the presence of magnetic fields.

Figure 3:
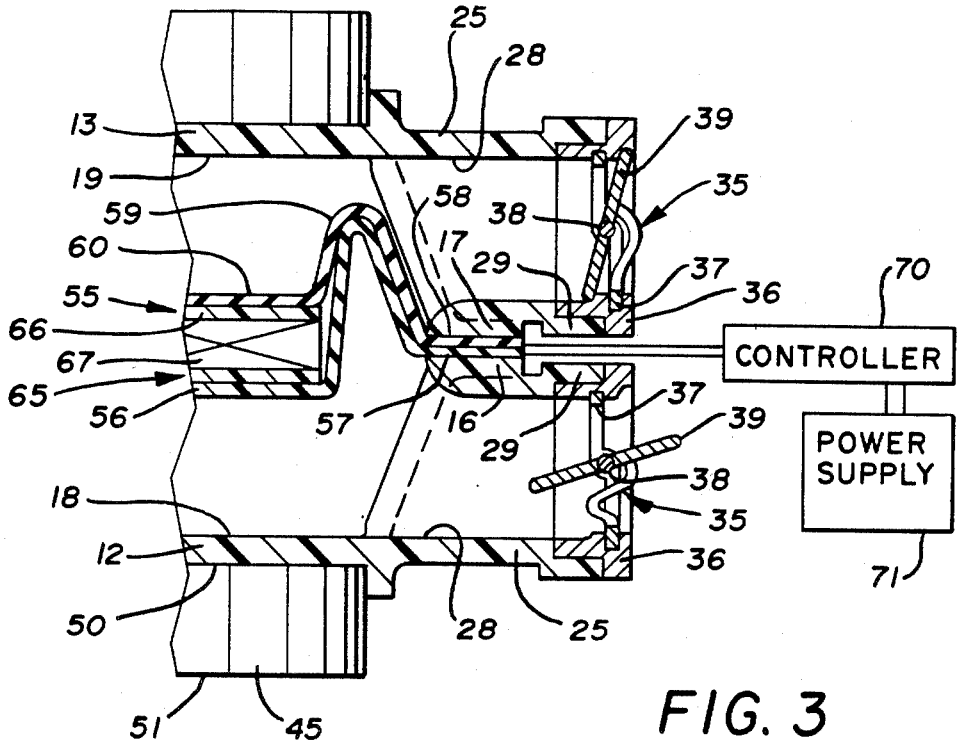
FIG. 3 is a fragmentary sectional view taken substantially along the line 3—3 of FIG. 1 and depicting details of the attachment of the septum to the housing, the positioning of the ports relative to the housing, and the valve elements located within the ports.

Referring particularly to FIGS. 1 and 3, each of the cup shaped sections 12 and 13 of pump housing 11 are apertured for the ingress and egress of fluid to be pumped. In this respect each of the cup shaped sections 12 and 13 have a substantially radially oriented inlet port 25 and an outlet port 26. The ports 25 and 26 have inner walls 28 as seen in conjunction with the inlet ports 25 which smoothly merge, as by substantially tangential orientation with respect to the end walls 18 and 19 and interior walls 14 and 15 of cup shaped sections 12 or 13, such as to facilitate the flow of fluid between the ports 25, 26 and the interior of the cup shaped sections 12, 13. The ports 25, 26 may terminate outwardly in annular flanges 29 to which conduits (not shown) may be attached for appropriately directing fluids which are supplied to and discharged from the pump 10. The smooth flow of fluid into and out of housing 11 and the lack of seams of significant size precludes fluid turbulence. In applications where the fluid is blood, less turbulent flow is believed to reduce the incidence of thrombus and minimize the possible development of a phenomenon known as pannus. It will also be appreciated that in heart implant applications the ports 25, 26 of sections 12 and 13 may be circumferentially relatively positioned for anatomic compatibility.

As can be seen in FIG. 1 of the drawings, the two inlet ports 25 are of a slightly greater diameter and thus a greater cross sectional area than the outlet ports 26. Thus, in instances of a continuous supply of fluid to the inlet ports 25 a continuous maximum capacity output will be discharged from the outlet ports 26 since the pump 10 does not become inlet flow dependent with the inlet ports 25 of a cross sectional area equal to or greater than the outlet ports 26.

In order to insure a unidirectional flow through both the inlet ports 25 and outlet ports 26, the annular flanges 29 may be adapted to receive valves, generally indicated by the numeral 35. As shown, the valves 35 on the inlet ports 25 consist of a shaped ring 36 adapted to fit within the annular flange 29. The ring 36 supports a valve housing 37 which includes a pivot 38 located preferably substantially medially thereof. The pivot 38 of the housing 37 carries a substantially circular disk 39 which moves from the closed position depicted in the top portion of FIG. 3 to the fully open position depicted at the bottom of FIG. 3. Valves comparable to valves 35 are mounted in the annular flanges 29 of each of the outlet ports 26 so as to permit only discharge of the working fluid through the inlet ports 26. The ring 36, housing 37 and disk 39 may be made of materials such as titanium and pyrolitic carbon if it is necessary to provide components that are biologically inert and, of significance in the instant application, nonmagnetic. The valves depicted in FIG. 3 of the drawings are an exemplary configuration meeting these requirements and are well known to persons skilled in the medical arts as the Medtronic Hall Prosthetic Valve.

Disposed at the ends of the pump housing are magnetic elements 45 and 46 which create stationary magnetic fields relative to the cylindrical housing 11. As shown, the cup shaped section 12 carries a magnetic element 45 and the cup shaped section 13 carries a magnetic element 46. As shown, the magnetic elements 45 and 46 are positioned within circular lips 47 and 48 formed in the cup shaped sections 12 and 13 and extending outwardly of the end walls 18 and 19. As shown, the magnetic elements 45 and 46 may be cylindrical and constituted of a permanent rare earth material. Further, as will be appreciated by persons skilled in the art, the particular material selected will depend upon the permissible size and weight of the magnetic elements 45, 46, the configuration of the housing 11 and other structural elements of the pump 10, and the characteristics of interacting magnetic components and the fields produced thereby. The magnetic elements 45 and 46 are normally affixed to the housing 11 in the positions shown and may be permanently or semi-permanently attached as by adhesive bonding or other attachment. If desired, the magnetic elements 45, 46 could be molded within the end walls 18 and 19, respectively. The material, size, configuration and thickness of the magnetic elements 45 and 46 may be varied to operate in conjunction with elements to be described hereinafter in such a manner as to provide the pressure and volumetric outputs of the fluid to be pumped as required.

The magnetic elements 45 and 46 are configured so that the poles are located proximate the axial surfaces. In the present invention the magnetic elements 45, 46 are arranged so that like poles 50 are in opposition, i.e., located adjacent to the end walls 18, 19 of sections 12 and 13. The other poles 51 of the magnetic elements 45, 46 are disposed at the axial extremities removed from the end walls 18, 19. It will be appreciated that either of the poles 50, 51 of magnetic element 45 may be adjacent the end wall 18 so long as the like pole of magnetic element 46 is similarly disposed relative to end wall 19.

Postioned within the housing 11 is a magnetically actuated septum 55 which serves to divide the pump 10 into a two-chambered configuration. The septum 55 includes a diaphragm 56 which extends from a position between the cup shaped sections 12 and 13. While various types of diaphragms 56 might be employed, the preferred diaphragm depicted in FIGS. 2 and 3 of the drawings is a form of rolling diaphragm. As shown, the rolling diaphragm 56 is of two-piece construction having a pair of joined flanges 57 and 58 which are of a circular configuration and are adapted for positioning within the radially outwardly projecting flanges 16 and 17 of the cup shaped sections 12 and 13. The flanges 57 and 58 are positioned within housing flanges 16 and 17 to effect a seal about the entire periphery upon the securing of fasteners 20 effecting joinder of the cup shaped sections 12 and 13. The flanges 57, 58 could be provided with a bead of any of a number of known configurations to effect or enhance sealing engagement with flanges 16, 17 of cup shaped sections 12, 13.

As can be seen by reference particularly to FIGS. 2 and 3, the diaphragm 56 has a convolution wall 59 positioned just radially inwardly of the flanges 57, 58. Radially inwardly of the convolution wall 59 is a pusher plate 60 of the diaphragm 56 which is preferably a substantially planar portion designed to effect reciprocating movement within the housing 11 between a position proximate to or in engagement with the end wall 18 of cup shaped section 12 to a position proximate to or in engagement with the end wall 19 of cup shaped section 13.

The interior walls 14 and 15 of cup shaped sections 12, 13 may conveniently be angled from the end walls 18 and 19, respectively, to the flanges 16 and 17, respectively, in such a fashion as to accommodate the convolution wall 59 portions of the diaphragm 56 without friction or contact which could cause energy loss. The rolling diaphragm 56 is particularly adapted for the instant environment in that it does not contemplate the elongation of the diaphragm material during movement between its various locations within housing 11. This is advantageous in that it is not necessary to take into account a spring factor in the displacement of the diaphragm 56, and in that there is no loss of energy in effecting an elongation of the rolling diaphragm 56 during the course of its travel from one extreme position proximate end wall 18 to the other extreme position proximate end wall 19. The rolling type diaphragm 56 may be constructed of any of a number of elastomeric materials which may or may not have reinforcing components or biologically inert metal foil of appropriate configuration based upon the performance characteristics of a particular design. It is to be appreciated that the rolling diaphragm 56 is a primary fluid engaging and displacing member of pump 10 such that in applications which would involve blood or other specialized fluids that the diaphragm 56 be constructed of or have its fluid engaging surfaces coated with a biologically inert or other appropriate material for the particular application.

The septum 55 is selectively flux coupled with the magnetic elements 45 and 46 by virtue of an electromagnet assembly, generally indicated by the numeral 65. The electromagnet assembly 65 may be positioned within the layers of the diaphragm 56 and particularly may constitute a portion of the pusher plate 60. Alternatively, the electromagnet assembly 65 could be attached outwardly of the diaphragm 56 to a side of the pusher plate 60 as by a suitable adhesive or other mechanical attachment. It will also be appreciated that the diaphragm 56 may be of single piece construction with electromagnet assembly 65 bonded thereto or encapsulated therein during or subsequent to molding.

As shown in the drawings, the electromagnet assembly 65 may consist of a cylindrical core or frame 66 upon which a coil 67 of magnetic wire may be wound in a manner well known to persons skilled in the art. A pump 10 capable of delivering a stroke volume of approximately 65 cubic centimeters from each of the chambers has been found to require a coil having an axial width of approximately three millimeters and containing 2600 windings of 36 AWG magnetic wire.

While characteristics of the coil wire 67 and core 66 could be varied to optimize flux strength and configuration for particular applications it is normally advantageous that the radial extremities of the electromagnet assembly 65 and normally the core 67 thereof be of a dimension such as to narrowly interfit within the interior walls 14 and 15 of the cup shaped sections 12 and 13 in order that substantially all fluid within each of the chambers of the pump 10 is evacuated during each pumping stroke effected by the excursion of the septum 55 into the respective chambers. It is also to be noted that this dimension of electromagnet assembly 65 radially relative to the housing 11 may be somewhat less than the radial dimension or diameter of the magnetic elements 45 and 46. In this manner, with the electromagnet assembly 65 and the magnetic elements 45, 46 being concentric, the interrelation between the flux fields of the magnetic elements 45 and 46 and the electromagnet assembly 65 is such that the pusher plate 60 mounting electromagnet assembly 65 moves between the extreme portions proximate the end walls 18 and 19 without the use of auxiliary guide elements or a diaphragm having elastic characteristics. Thus, the position and orientation of the electromagnet assembly 65 is controlled by the interrelation of its flux field with the flux fields established by the permanent magnetic elements 45 46.

The electromagnet assembly 65 is moved axially of the housing 11 to alternately effect the ingress and egress of fluid from the inlet and outlet ports to either side of the septum 55 by alternating the polarity of the electromagnet assembly 65. In particular, the electromagnet assembly 65 would have its lower portion as depicted in FIGS. 2 and 3 of the same polarity as the surface 50 of magnetic element 45 to create repelling forces between the end wall 12 and septum 55 to drive the diaphragm 56 upwardly to effect a fluid output pumping stroke for the upper chamber and a fluid input stroke for the lower chamber. As the electromagnet assembly 65 moves upwardly through the intermediate position depicted in solid lines, the repelling force continues while the upper surface of electromagnet assembly 65 which is of opposite polarity is continually increasingly attracted to the lower pole 50 of magnetic element 46. When the electromagnet assembly 65 approaches the end wall 19 as depicted in chain lines in FIG. 2, the polarity of the electromagnet assembly 65 is reversed. At that point the upper surface of electromagnet assembly 65 has its polarity reversed to the opposite polarity which is the same as the lower surface 50 of magnetic element 46 such as to effect the institution of repelling forces between the surfaces and the institution of a condition opposite that just described to effect the displacement of the electromagnet assembly 65 and thus the septum 55 from the upper chain line to the lower chain line position depicted in FIG. 2. The continuous operation of the pump 10 is thus effected by the alternating reversal of the polarity of the electromagnet assembly 65.

This reversal of the polarity of the electromagnet assembly 65 may be effected by a controller 70 as seen in FIG. 3 which is attached to the coil of magnetic wire 67 of electromagnet assembly 65. The controller 70 effects a reversal of the direction of current flow through the coil 67 to create the reversal of poles of the electromagnet assembly 65 discussed hereinabove. The controller 70 may, as will be appreciated by persons skilled in the art, be a solid state semi-programmable unit capable of providing electrical current of variable amplitude, duration and repetition rates over selected values. If desired, for heart applications a conventional pacemaker may be employed to actuate the controller 70 in regard to the repetition rate.

The presence of the magnetic elements 45 and 46 as highly efficient permanent magnets enables the pump 10 to operate for extended time periods with minimum power requirements. The controller 70 is attached in FIG. 3 to a direct current power supply 71 which powers the controller 70 and the coil 67. With a coil of the characteristics described heeinabove and with relatively efficient magnetic elements 45 and 46, the electromagnet assembly 65 may be actuated as for example to simulate heart functions by connecting the coil via the controller 70 with a low voltage source with relatively low current demand. It will thus be appreciated that the controller 70 and power supply 71 may be of minimal size while providing for operation of the pump 10 for extended time periods. It will also be appreciated that increasing the operating efficiency of coil 67 or permanent magnets 45 or the size thereof, if permissible for a particular application, can result in further reduced power consumption by the pump 10. Further, for certain applications it may be desirable that the magnetic elements 45, 46 be electromagnets with the assembly 65 being either a permanent magnet or an electromagnet.

Figure 4:
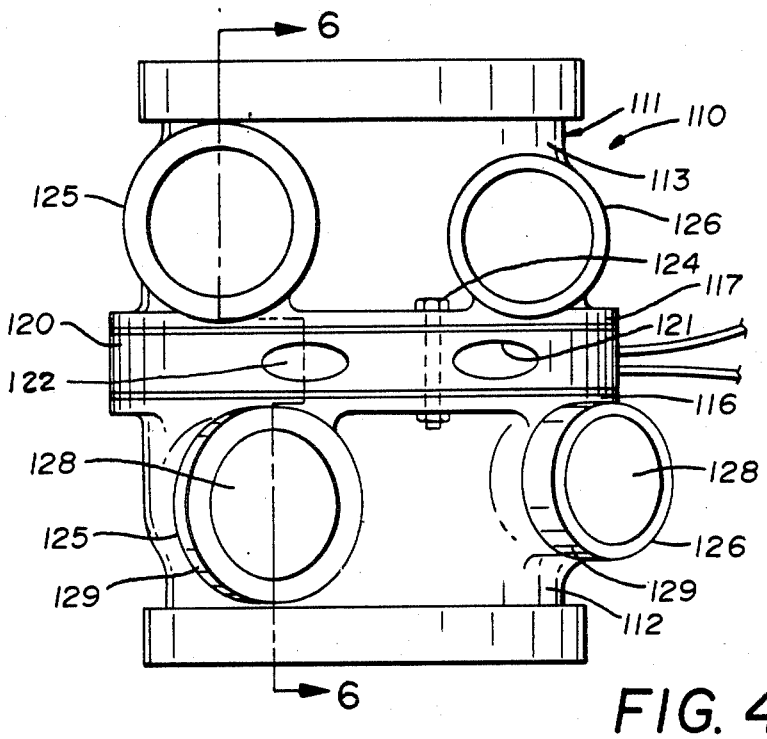
FIG. 4 is a top plan view of a second embodiment of pump apparatus depicting additional concepts of the present invention and showing inlet ports and outlet ports which communicate with each of two chambers within the housing.
Figure 5:
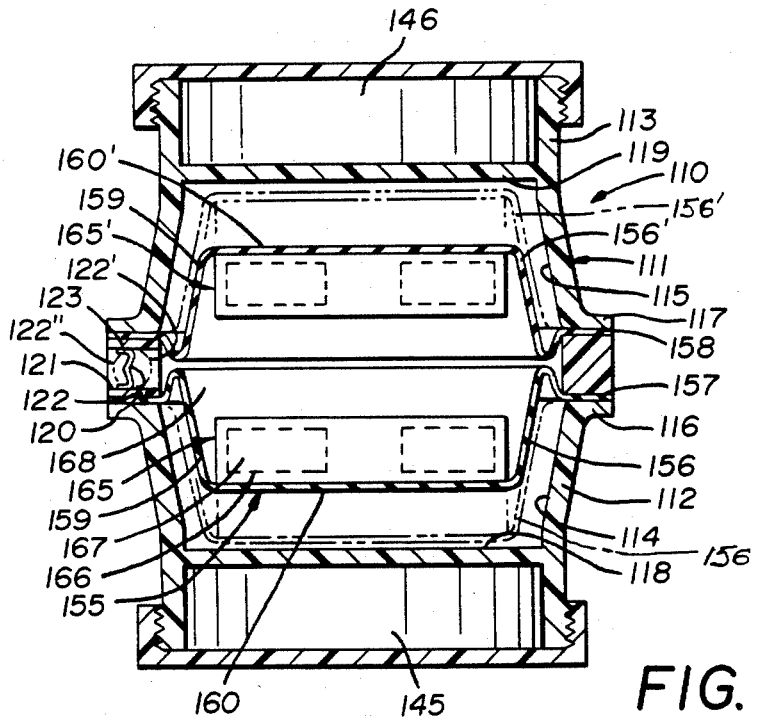
FIG. 5 is a sectional view taken substantially along the line 5—5 of FIG. 6 and depicting details of the septum within the housing and particularly the dual diaphragm configuration of the second embodiment of the invention.
Figure 6:
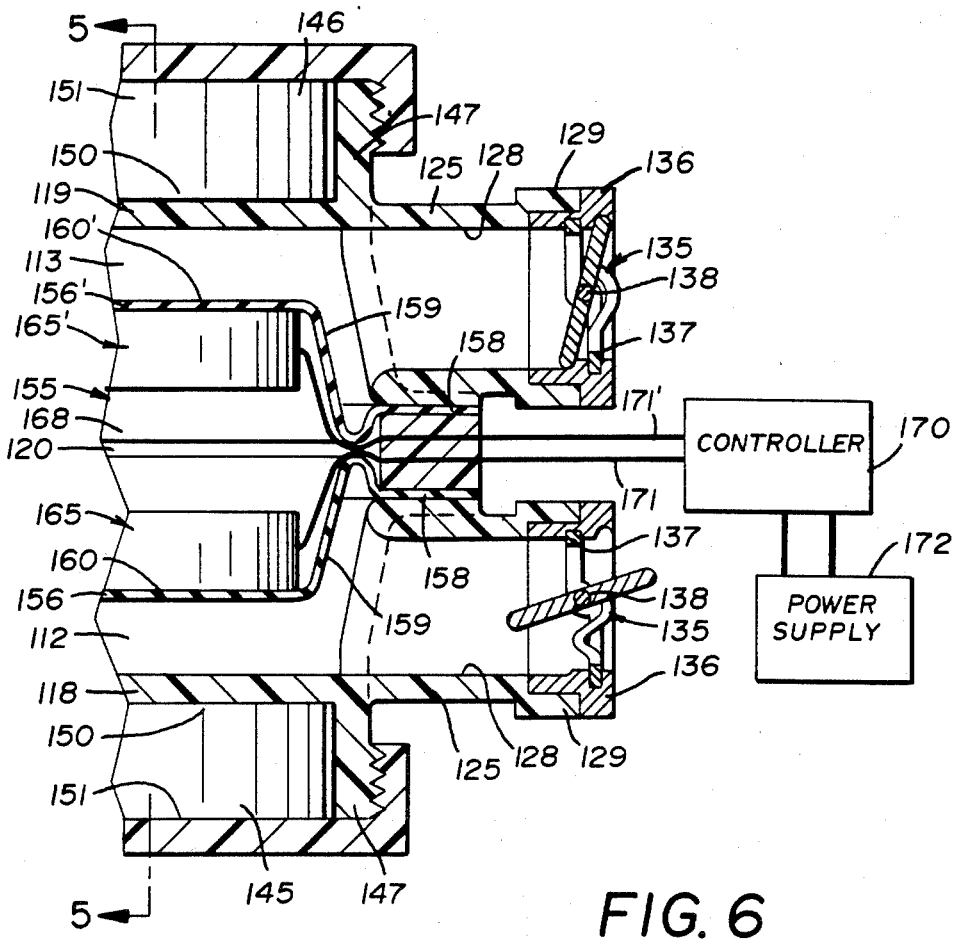
FIG. 6 is a fragmentary sectional view taken substantially along line 6—6 of FIG. 4 and depicting details of the septum and the valve elements in the ports.

Referring generally to FIGS. 4–6 of the drawings and particularly to FIG. 4 thereof, pump apparatus embodying the concepts of the second embodiment of the present invention is generally indicated by the numeral 110. The pump 110 has a substantially closed, cylindrical housing, generally indicated by the numeral 111. As best seen in FIGS. 4 and 5, the pump housing 111 may have two cup shaped sections 112 and 113. Each of the cup shaped sections 112 and 113 are hollow as defined by interior walls 114 and 115 which terminate in radially outwardly projecting flanges 116 and 117. The axial extremity of sections 112, 113 opposite the flanges 116, 117 have cylindrical end walls 118 and 119, respectively. Interposed between the flanges 116, 117 of sections 112, 113 is an annular spacer, indicated by the numeral 120. As shown the spacer 120 has a plurality of apertures 121 which may be elongate and each mount a flexible air impervious membrane 122 therein for a purpose described hereinafter. The membrane 122 may be adhesively mounted within apertures 121 by a peripheral attachment flange 123 such that there is substantial slack in membrane 122 as seen in FIG. 5. The closed configuration of the housing 111 is effected by joining the flanges 116 and 117 to pacer 120 about their entire peripheries. The sections 112, 113 and spacer 120 may be selectively joined as by a plurality of fasteners 124 such as screws or bolts which permit the sealed joinder of sections 112, 113 and spacer 120 or their intermittent disassembly for purposes of repair or replacement, cleaning or adjustment of parts within the housing 111.

For general pumping applications, the housing 111 may be constructed of polyurethane, epoxy, or other plastics having comparable properties. If the pump 110 is to be used as an artificial heart the housing 111 or at least the fluid contacting surfaces would be constructed of a substantially rigid but suitably inert material with respect to blood such as titanium or a urethane polymer such as a product sold under the name Pellathane. For reasons which will be hereinafter apparent, the material of the housing 111 should in addition to being biologically inert be of a nonmagnetic material which would not affect or be affected by the presence of magnetic fields.

Referring particularly to FIGS. 4 and 6, each of the cup shaped sections 112 and 113 of pump housing 111 are apertured for the ingress and egress of fluid to be pumped. In this respect each of the cup shaped sections 112 and 113 have a substantially radially oriented inlet port 125 and an outlet port 126. The ports 125 and 126 have inner walls 128 as seen in conjunction with the inlet ports 125 which smoothly merge, as by substantially tangential orientation with respect to the end walls 118 and 119 and interior walls 114 and 115 of cup shaped sections 112 or 113, such as to facilitate the flow of fluid between the ports 125, 126 and the interior of the cup shaped sections 112, 113. The ports 125, 126 may terminate outwardly in annular flanges 129 to which conduits (not shown) may be attached for appropriately directing fluids which are supplied to and discharged from the pump 110. The smooth flow of fluid into and out of housing 111 and the lack of seams of significant size precludes fluid turbulence. In applications where the fluid is blood, less turbulent flow is believed to reduce the incidence of thrombus and minimize the possible development of a phenomenon known as pannus. It will also be appreciated that, as seen in FIG. 4 particularly, in heart implant applications the ports 125, 126 of sections 112 and 113 may be circumferentially differently spaced and/or the sections 112, 113 differently circumferentially relatively positioned for enhanced anatomic compatibility.

As can be seen in FIG. 4 of the drawings, the two inlet ports 125 are of a slightly greater diameter and thus a greater cross sectional area than the outlet ports 126 as disclosed in relation to ports 25, 26 of FIG. 1. Thus, in instances of a continuous supply of fluid to the inlet ports 125 a continuous maximum capacity output will be discharged from the outlet ports 126 since the pump 110 does not become inlet flow dependent with the inlet ports 125 of a cross sectional area equal to or greater than the outlet ports 126.

In order to insure a unidirectional flow through both the inlet ports 125 and outlet ports 126, the annular flanges 129 may be adapted to receive valves, generally indicated by the numeral 135 in FIG. 6, which are identical to valves 35 of FIG. 3. As shown, the valves 135 on the inlet ports 125 consist of a shaped ring 136 adapted to fit within the annular flange 129. The ring 136 supports a valve housing 137 which includes a pivot 138 located preferably substantially medially thereof. The pivot 138 of the housing 137 carries a substantially circular disk 139 which moves from the closed position depicted in the top portion of FIG. 6 to the fully open position depicted at the bottom of FIG. 6. Valves comparable to valves 135 are mounted in the annular flanges 129 of each of the outlet ports 126 so as to permit only discharge of the working fluid through the inlet ports 126. The ring 136, housing 137 and disk 139 may be made of materials such as titanium and pyrolitic carbon if it is necessary to provide components that are biologically inert and, of significance in the instant application, nonmagnetic. The valves depicted in FIGS. 3 and 6 of the drawings are an exemplary configuration meeting these requirements and are well known to persons skilled in the medical arts as the Medtronic Hall Prosthetic Valve.

Disposed at the ends of the pump housing are magnetic elements 145 and 146 which create stationary magnetic fields relative to the cylindrical housing 11 in a manner comparable to magnetic elements 45, 46. As shown, the cup shaped section 112 carries a magnetic element 145 and the cup shaped section 113 carries a magnetic element 146. As shown, the magnetic elements 145 and 146 are positioned within exteriorly threaded circular projections 147 and 148 formed in the cup shaped sections 112 and 113 and extending outwardly of the end walls 118 and 119. As shown, the magnetic elements 145 and 146 may be cylindrical and constituted of a permanent rare earth material. Further, as will be appreciated by persons skilled in the art, the particular material selected will depend upon the permissible size and weight of the magnetic elements 145, 146, the configuration of the housing 111 and other structural elements of the pump 110, and the characteristics of interacting magnetic components and the fields produced thereby. The magnetic elements 145 and 146 are normally affixed to the housing 111 in the positions shown and may be permanently or semi-permanently attached as by the interiorly threaded caps 149 which engage the threaded circular projections 147 and 148. If desired, the magnetic elements 145, 146 could be molded within or adhesively bonded to the end walls 118 and 119, respectively. The material, size, configuration and thickness of the magnetic elements 145 and 146 may be varied to operate in conjunction with elements to be described hereinafter in such a manner as to provide the pressure and volumetric outputs of the fluid to be pumped as required.

The magnetic elements 145 and 146 are configured so that the poles are located proximate the axial surfaces. In the present invention the magnetic elements 145, 146 are arranged so that like poles 150 are in opposition, i.e., located adjacent to the end walls 118, 119 of sections 112 and 113. The other poles 151 of the magnetic elements 145, 146 are disposed at the axial extremities removed from the end walls 118, 119, i.e., proximate to caps 149. Either of the poles 150, 151 of magnetic element 145 may be adjacent the end wall 118 so long as the like pole of magnetic element 146 is similarly disposed relative to end wall 119.

Positioned within the housing 111 is a magnetically actuated septum 155 which serves to divide the pump 110 into a two-chambered configuration. The septum 155 includes a first diaphragm 156 and a second diaphragm 156′ which extend from a position between the cup shaped sections 112 and spacer 120 and cup shaped sections 113 and spacer 120, respectively. While various types of diaphragms 156 might be employed, the preferred diaphragm depicted in FIGS. 5 and 6 of the drawings is a form of rolling diaphragm. As shown, the rolling diaphragms 156, 156′ are of single piece construction having flanges 157 and 158, respectively, which are of a circular configuration and are adapted for positioning within the radially outwardly projecting flanges 116 and 117 of the cup shaped sections 112 and 113 and spacer 120, respectively. The flanges 157 and 158 are positioned to effect a seal about the entire periphery upon the securing of fasteners 124 effecting joinder of the cup shaped sections 112 and 113 and spacer 120. The flanges 157, 158 could be provided with a bead of any of a number of known configurations to effect or enhance sealing.

As can be seen by reference particularly to FIGS. 4 and 6, the diaphragms 156, 156′ have convolution walls 159 positioned just radially inwardly of the flanges 157, 158. Radially inwardly of the convolution walls 159 are pusher plates 160, 160′ of the diaphragms 156, 156′ which are preferably a substantially planar portion designed to effect alternating reciprocating movement within the housing 111 between a position proximate to or in engagement with the end wall 118 of cup shaped section 112 or with the end wall 119 of cup shaped section 113, respectively, to positions displaced a distance therefrom.

The interior walls 114 and 115 of cup shaped sections 112, 113 may conveniently be angled from the end walls 118 and 119, respectively, to the flanges 116 and 117, respectively, in such a fashion as to accommodate the convolution wall 159 portions of the diaphragms 156, 156′ without friction or contact which could cause energy loss. The rolling diaphragms 156, 156′ are particularly adapted for the instant environment in that it does not contemplate the elongation of the diaphragm material during movement between its various locations within housing 111. This is advantageous in that it is not necessary to take into account a spring factor in the displacement of the diaphragms 156, 156′, and in that there is no loss of energy in effecting an elongation of the diaphragms during their course of travel. The rolling type diaphragms 156, 156′ may be constructed of any of a number of elastomeric materials which may or may not have reinforcing components or biologically inert metal foil of appropriate configuration based upon the performance characteristics of a particular design. It is to be appreciated that the rolling diaphragms 156, 156′ are a primary fluid engaging and displacing member of pump 110 such that, in applications which would involve blood or other specialized fluids, the diaphragms 156, 156′ may be constructed of or have their fluid engaging surfaces coated with a biologically inert or other appropriate material for the particular application.

The septum 155 is selectively flux coupled with the magnetic elements 145 and 146 by virtue of electromagnet assemblies, generally indicated by the numerals 165 and 165′. The electromagnet assemblies 165, 165′ may be positioned within the layers of the diaphragms 156, 156′ or alternatively, as shown in FIGS. 5 and 6, attached inwardly of the diaphragms 156, 156′ to a side of the pusher plates 160, as by a suitable adhesive or other mechanical attachment, within a compartment 168 defined by the diaphragms 156, 156′ and spacer 120. As shown in FIG. 5 of the drawings, the electromagnet assemblies 165, 165′ may each consist of a cylindrical core or frame 166 upon which a coil 167 of magnet wire may be wound in a manner well known to persons skilled in the art.

While characteristics of the coil wire 167 and core 166 could be varied to optimize flux strength and configuration for particular applications it is normally advantageous as in the case of the FIG. 1 embodiment, that the radial extremities of the electromagnet assemblies 165, 165′ and normally the cores 166 thereof be of a dimension such as to narrowly interfit within the interior walls 114 and 115 of the cup shaped sections 112 and 113 in order that substantially all fluid within each of the chambers of the pump 110 is evacuated during each pumping stroke effected by the excursion of the diaphragms 156, 156′ into the respective chambers. It is also to be noted that this dimension of electromagnet assemblies 165, 165′ radially relative to the housing 111 may be somewhat less than the radial dimension or diameter of the magnetic elements 145 and 146. In this manner, with the electromagnet assemblies 165, 165′ and the magnetic elements 145, 146 being concentric, the interrelation between the flux fields of the magnetic elements 145 and 146 and the electromagnet assemblies 165, 165′ is such that the pusher plate 160 mounting electromagnet assemblies 165, 165′ move between their extreme positions without the use of auxiliary guide elements or a diaphragm having elastic characteristics. Thus, the position and orientation of the electromagnet assemblies 165, 165′ are controlled by the interrelation of their flux fields with the flux fields established by the permanent magnetic elements 145, 146.

The electromagnet assemblies 165, 165′ are alternately moved axially of the housing 111 to alternately effect the egress of fluid from the outlet ports 126 to either side of the septum 155 by alternately energizing and deenergizing the electromagnet assemblies 165, 165'. In particular, the electromagnet assembly 165' would be energized to have its lower portion, as depicted in FIGS. 5 and 6, of the same polarity as the surface 150 of magnetic element 145 to create repelling forces to drive the diaphragm 156' upwardly to effect a fluid output pumping stroke for the upper chamber. As the electromagnet assembly 165' moves upwardly the repelling force continues while the upper surface of electromagnet assembly 165' which is of opposite polarity is continually increasingly attracted to the lower pole 150 of magnetic element 146. When the diaphragm 156' approaches the end wall 119, as depicted in chain lines in FIG. 5, the electromagnet assembly 165' is deenergized. During this time period electromagnet assembly 165 is deenergized and diaphragm 156 moves upwardly solely in response to the pressure and quantity of fluid supplied through the inlet port 125 below diaphragm 156.

At that point the electromagnet assembly 165 is energized so that its polarity is opposite the polarity of the lower surface 150 of magnetic element 146 such as to effect the institution of repelling forces between the surfaces and the institution of a condition opposite that just described to effect the displacement of the electromagnet assembly 165 and thus the diaphragm 156 from its upper fill position achieved during the pumping stroke of diaphragm 156' to the lower chain line position depicted in FIG. 5. The remainder of this cycle is a reversal of the action described above of the diaphragm 156'. The continuous operation of the pump 110 is thus effected by alternately energizing and deenergizing the electromagnet assemblies 165 and 165'.

Since the diaphragms 156 and 156' operate totally independently, the volume of the compartment 168 necessarily varies with each variation in the axial distance between the diaphragms. In order to preclude variations in air pressure in the compartment 168 which could apply forces to the diaphragms, the compartment 168 preferably communicates with a compliance chamber device. As shown, the membranes 122 and the apertures 121 in the spacer 120 serve as a compliance chamber in that the slackly mounted membranes 122 may deform radially inwardly or outwardly to accommodate variations in air pressure. As seen in FIG. 5, the membranes 122 may be displaced to a membrane configuration 122' attendant the reduction of air pressure within compartment 136 and to a membrane configuration 122" upon an increase in air pressure within compartment 168 as upon the movement of diaphragms 156, 156' into relatively close proximity. It should also be appreciated that the compartment 168 could be connected as by a conduit to a remote compliance chamber being one of the types which are commercially available as will be appreciated by persons skilled in the art.

The independent operation of the diaphragms 156 and 156' creates the possibility of altering the pump 110 to accommodate a greater or lesser maximum output capability through either of the outlet ports 126 without diminishing the operating efficiencies and advantages of the pump. In this respect either of the cup shaped sections 112 and 113 could be extended or reduced in axial dimensions to accommodate greater or lesser quantities of fluid, respectively. In order to optimize performance of a pump 110 so altered, the diaphragm 156 or 156' associated with an altered cup section 112 or 113 should have its axial reach similarly altered in order to achieve the optimum discharge of virtually all fluid during a pumping stroke while stopping the diaphragm a distance spaced from but in close proximity to the end walls 118, 119.

This energizing and deenergizing of the electromagnet assemblies 165 and 165' may be effected by a controller 170 as seen in FIG. 6 which is attached as by wires 171 and 171' to the coils 167 of electromagnet assembly 165 and 165', respectively. The controller 170 effects a timed directional current flow through the coils 167 to create the timed pumping strokes of the electromagnet assemblies 165, 165' discussed hereinabove. The controller 170 may, as will be appreciated by persons skilled in the art, be a solid state semi-programmable unit capable of providing electrical current of variable amplitude, duration and repetition rates at selected values to two different inputs, electromagnet assemblies 165 and 165'. If desired, for heart applications a conventional pacemaker may be employed to actuate the controller 170 in regard to the repetition rate.

The usage of the magnetic elements 145 and 146 as highly efficient permanent magnets enables the pump 110 to operate for extended time periods with minimum power requirements. The controller 170 is attached in FIG. 6 to a direct current power supply 172 which powers the controller 170 and the coils 167. With coils 167 of the characteristics described hereinabove and with relatively efficient magnetic elements 145 and 146, the electromagnet assemblies 165, and 165' may be actuated as for example to simulate heart functions by connecting the coils via the controller 170 with a low voltage source with relatively low current demand. It will thus be appreciated that the controller 170 and power supply 172 may be of minimal size while providing for operation of the pump 110 for extended time periods. It will also be appreciated that increasing the operating efficiency of coils 167 or permanent magnets 145, 146 or the size thereof, if permissible for a particular application, can result in further reduced power consumption by the pump 110.

Thus it should be evident that the pump device disclosed herein carries out the various objects of the invention set forth hereinabove and otherwise constitutes an advantageous contribution to the art. As may be apparent to persons skilled in the art, modifications can be made to the preferred embodiment disclosed herein in regard to the size, shape, material and, in some instances, electrical characteristics of various of the components without departing from the spirit of the invention, the scope of the invention being limited solely by the scope of the attached claims.

We claim:

1. Pump apparatus for the controlled ingress and egress of a fluid comprising, a generally cylindrical rigid housing, flexible septum means disposed within said housing, flexible septum means disposed within said housing and attached to said housing substantially axially medially thereof, electromagnetic means affixed to said septum means, a pair of inlet ports in said housing means with one disposed to either side of said septum means, valve means in said inlet port means permitting only ingress of fluid to said housing, a pair of outlet ports in said housing means with one disposed to either side of said septum means, valve means in said outlet port means permitting only the egress of fluid from said housing, a pair of permanent magnet means with one disposed proximate each of the axial extremities of said housing, and means for selectively energizing said electromagnetic means for flux coupling with each of said pair of permanent magnet means to produce the controlled displacement of said septum means axially of said housing to alternately effect the ingress and egress of fluid from said inlet and outlet ports to either side of said septum means.

2. Apparatus according to claim 1, wherein said inlet ports are of a greater cross-sectional area than said outlet ports.

3. Apparatus according to claim 2, wherein said ports are cylindrical, said inlet ports being of a greater diameter than said outlet ports.

4. Apparatus according to claim 1, wherein end walls are located at the axial extremity of said housing, said outlet ports having inner walls smoothly merging with said end walls.

5. Apparatus according to claim 4, wherein said inlet ports have inner walls which smoothly merge with said end walls of said housing, whereby the incidence of fluid turbulence is minimized.

6. Apparatus according to claim 1, wherein the dimension of said electromagnetic means radially of said housing means is less than the dimension of said permanent magnet means radially of said housing means.

7. Apparatus according to claim 6, wherein said electromagnetic means includes a coil and said permanent magnet means are cylindrical, said coil of said electromagnetic means and said permanent magnet means being concentric.

8. Apparatus according to claim 7, wherein the outside diameter of said coil of said electromagnetic means is less than the diameter of said permanent magnet means.

9. Apparatus according to claim 1, wherein said means for selectively energizing said electromagnetic means effects alternating reversals of polarity of said electromagnetic means.

10. Apparatus according to claim 9, wherein said electromagnetic means includes coil means and said means for selectively energizing said electromagnetic means includes a controller which selectively reverses the direction of flow of current in said coil means.

11. Apparatus according to claim 10, wherein said controller means provides electrical current of variable amplitude, duration, and repetition rates over selected value ranges.

12. Apparatus according to claim 1, wherein said permanent magnet means have the like poles thereof in opposition.

13. Apparatus according to claim 12, wherein said electromagnetic means includes coil means electromagnetically energized to alternately establish repelling forces with each of said permanent magnet means when in close proximity thereto.

14. Apparatus according to claim 1, wherein said septum means is a rolling diaphragm.

15. Apparatus according to claim 14, wherein said diaphragm has peripheral flange means for sealing attachment to said housing, a centrally located pusher plate, and a convolution wall interposed between said flange means and said pusher plate.

16. Apparatus according to claim 15, wherein said electromagnetic means is positioned within said pusher plate of said diaphragm.

17. Apparatus according to claim 16, wherein said electromagnetic means includes a core having windings of magnetic wire thereon.

18. Apparatus according to claim 1, wherein said septum means interfits within said housing such as to discharge substantially all of the fluid to one side of said septum means upon movement to effect the egress of fluid therefrom.

19. Pump apparatus for the controlled ingress and egress of a fluid comprising, a generally cylindrical hollow housing, septum means having first and second diaphragm means disposed within and attached to said housing, electromagnetic means affixed to each of said diaphragm means, a pair of inlet ports in said housing means with one disposed to either side of said septum means, valve means in said inlet port means permitting only ingress of fluid to said housing, a pair of outlet ports in said housing means with one disposed to either side of said septum means, valve means in said outlet port means permitting only the egress of fluid from said housing, a pair of permanent magnet means disposed in said housing axially outwardly of said ports, and means for selectively energizing said electromagnetic means for the controlled displacement of said diaphragm means axially of said housing to alternately permit the ingress and effect the egress of fluid from said inlet and outlet ports to either side of said septum means.

20. Apparatus according to claim 19, wherein said means for selectively energizing said electromagnet means alternately energizes the electromagnetic means affixed to said first diaphragm means and the electromagnetic means affixed to said second diaphragm means.

21. Apparatus according to claim 19, wherein said housing has spacer means interposed between said diaphragm means.

22. Apparatus according to claim 21, wherein said spacer means is an annular member interposed between and spacing axially of said housing where said first and second diaphragm means are attached to said housing.

23. Apparatus according to claim 19, including compliance chamber means communicating with a compartment formed between said first and second diaphragm means to preclude substantial variations of air pressure therein.

24. Apparatus according to claim 23 wherein said compliance chamber means is formed in spacer means interposed between said diaphragm means.

25. Apparatus according to claim 24 wherein said spacer means has aperture means mounting membrane means to permit the free flow of air into and out of said compartment between said first and second diaphragm means to provide independent operation of said first and second diaphragm means.

26. Apparatus according to claim 19 wherein said electromagnetic means affixed to each of said diaphragm means are positioned between said first and second diaphragm means.

27. Apparatus according to claim 19, wherein said means for selectively energizing said electromagnetic means is a controller.

28. Pump apparatus for the controlled ingress and egress of a fluid comprising, a generally cylindrical rigid housing, flexible septum means disposed within and attached to said housing, electromagnetic means affixed to said septum means, inlet port means in said housing means disposed to one side of said septum means, valve means in said inlet port means permitting only ingress of fluid to said housing, outlet port means in said housing means disposed to the same side of said septum means, valve means in said outlet port means permitting only the egress of fluid from said housing, a pair of permanent magnet means attached to said housing axially outwardly of said ports, and means for selectively energizing said electromagnetic means for flux coupling with each of said pair of permanent magnet means to produce the controlled displacement of said septum means axially of said housing to alternately effect the ingress and egress of fluid from said inlet and outlet ports.

* * * * *

UNITED STATES PATENT AND TRADEMARK OFFICE

CERTIFICATE OF CORRECTION

PATENT NO. : 4,786,240

DATED : Nov. 22, 1988

INVENTOR(S) : Michael V. Koroly and Nathan Ida

It is certified that error appears in the above-identified patent and that said Letters Patent is hereby corrected as shown below:

Col. 8, Line 67, "heeinabove" should read --hereinabove--

Col. 9, Line 38, "pacer" should read --spacer--

Claim 1, Col. 14, Lines 56 & 57, delete "flexible septum means disposed within said housing," first occurrence.

Signed and Sealed this

Twenty-first Day of November, 1989

*Attest:*

JEFFREY M. SAMUELS

*Attesting Officer* *Acting Commissioner of Patents and Trademarks*